United States Patent [19]

Kaufman et al.

[11] 4,129,135

[45] Dec. 12, 1978

[54] SMOKER'S TOOL

[76] Inventors: Michael P. Kaufman; Randal S. Kochenderfer; Frank A. Crivello, all of 826 Fulton SE., Minneapolis, Minn. 55414

[21] Appl. No.: 860,950

[22] Filed: Dec. 15, 1977

[51] Int. Cl.[2] ..... A24F 9/08

[52] U.S. Cl. ..... 131/243; 131/247; 131/259

[58] Field of Search ..... 131/243, 245, 246, 247, 131/240, 257, 259, 260

[56] References Cited

U.S. PATENT DOCUMENTS

| | | | |
|---|---|---|---|
| 1,881,641 | 10/1932 | Jones | 131/259 |
| 2,214,386 | 9/1940 | Snyder | 131/246 |
| 2,894,515 | 7/1959 | Wismer, Jr. | 131/247 X |
| 3,071,141 | 1/1963 | McIlwain | 131/257 X |

FOREIGN PATENT DOCUMENTS

| | | | |
|---|---|---|---|
| 203754 | 11/1939 | Switzerland | 131/243 |

*Primary Examiner*—Stephen C. Pelligrino
*Attorney, Agent, or Firm*—Jacobson and Johnson

[57] ABSTRACT

A combination pipe and cigarette tool having a pair of slidable implements with one implement having a retractable cutting or scraper blade on one end and a tamper on the opposite end which can be locked in an operating or closed position in the pipe and cigarette tool housing. The second slidable implement includes a pipe pick on one end and cigarette clip on the opposite end which can hold a burning cigarette against the housing. When not in use a clip attached to the housing allows the tool to be clipped to a shirt pocket.

9 Claims, 8 Drawing Figures

FIG. 1
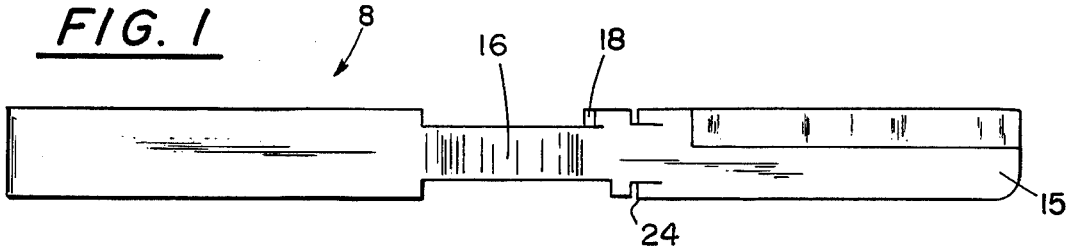
FIG. 2
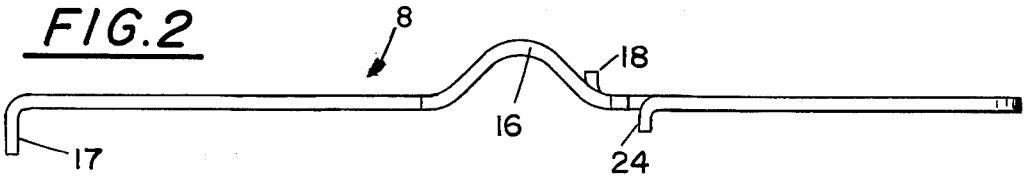
FIG. 3
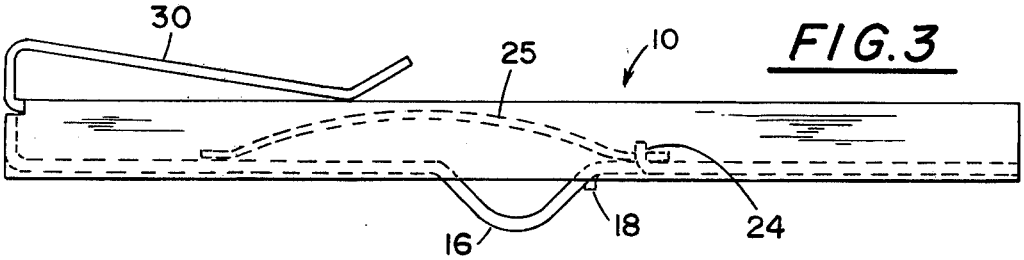
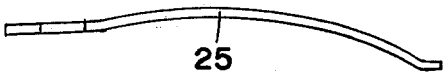
FIG. 4
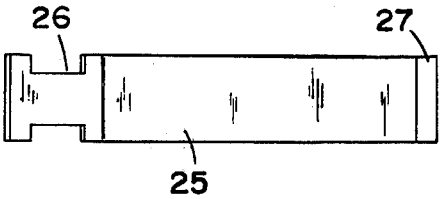
FIG. 5
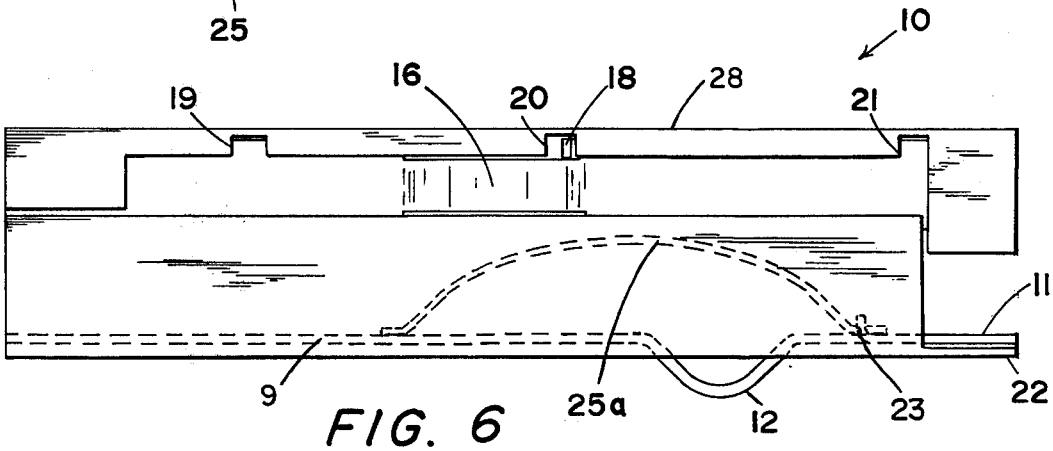
FIG. 6

SMOKER'S TOOL

BACKGROUND OF THE INVENTION

1. Field of the Invention

This invention relates generally to a smoker's articles and, more specifically, to a compact combination cigarette and pipe tool.

2. Description of the Prior Art

The concept of holders for cigarettes or pipe tools is old in the art. The Brush U.S. Pat. No. 2,250,178 shows a typical prior art device used as a cigarette holder. Brush has a horizontal coil spring mounted to an ash tray. The individual coils resiliently hold a cigarette therebetween.

The Vitale U.S. Pat. No. 3,426,762 similarly shows a coil spring cigarette holder.

The Thayer U.S. Pat. No. 2,001,827 shows a finger holding a burning cigarette against the end wall of a match box.

The concept of pipe tools is also well known in the art. The Middleton U.S. Pat. No. 2,536,852 has four pipe tools pivotally mounted on one end of a casing. The tools pivot in or out of the casing.

The Grossman U.S. Pat. No. 3,327,717 shows a cylindrical housing and three pipe tools that are pivotal from one end of the pipe tool.

The Walker U.S. Pat. No. 865,547 shows a pipe tool having three pipe tools pivotally mounted to each other.

The Blom U.S. Pat. No. 1,530,348 shows a prior art pipe cleaner having three pipe tools which are pivotable into an elongated casing.

The Thornton U.S. Pat. No. 1,558,652 shows a pipe cleaner containing a slidably mounted cylindrical pick for cleaning a pipe passage.

The Wismer U.S. Pat. No. 2,894,515 shows a pipe, pick and tamper slidably mounted within a central barrel.

The Synder U.S. Pat. No. 2,214,386 shows a pipe bowl cleaner which is slidably mounted within a sheathing-like case.

The Patton U.S. Pat. No. 3,814,109 shows a pipe tool which is adapted for carrying in a pocket and provided with a knife blade for scraping a pipe bowl, a pick for cleaning the pipe stem and a tamping surface for tamping tobacco.

All these prior art inventions relate primarily to either a pipe tool or a cigarette holding device and not to a combination pipe and cigarette tool. The present invention provides improvement to the prior art devices by providing a new and improved compact smoker's tool usable by either a cigarette or pipe smoker.

SUMMARY OF THE INVENTION

Briefly, the present invention comprises a smoker's tool with a first slidable implement having a knife on one end for scraping and cleaning a pipe bowl and a tamper on the opposite end for tamping tobacco in a pipe bowl. The second slidable member has a pick on one end for cleaning a pipe and a clip on the other end for holding a cigarette against a lip of the tool housing. Both implements are slidably mounted and can be locked in the housing.

BRIEF DESCRIPTION OF THE DRAWING

FIG. 1 is a front view of the pipe scraper and pipe tamp;

FIG. 2 is a side view of the pipe scraper and pipe tamp;

FIG. 3 is a side view of the smoker's tool;

FIG. 4 is a side view of the retaining spring;

FIG. 5 is a top view of the retaining spring;

FIG. 6 is a front view of the smoker's tool;

DESCRIPTION OF THE PREFERRED EMBODIMENT

Figure 7:
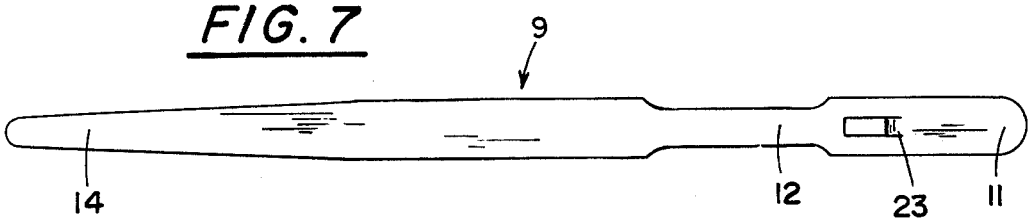
FIG. 7 is a top view of the cigarette holder and pipe pick.

FIG. 1 and FIG. 2 show a first slidable implement 8 having a scraper blade 15 on one end and a tobacco tamper pad 17 on the opposite end. Intermediate scraper blade 15 and tamper pad 17 is a curved thumb grip 16. With implement 8 mounted in an implement passage in housing 10, thumb grip 16 projects through the side of tool housing 10 (FIG. 3). Grip 16 allows a user to slide either blade 15 or tamper 17 out of the end of tool housing 10. Blade 15 and tamper 17 are slidably held within the confines of an implement passage in housing 10 by an arcuate leaf spring 25 (FIG. 4). On one end of spring 25 is a notch 26 for engaging members 24 projecting from implement 8. The opposite end of spring 25 contains a flat section 27 for holding the tamper end of implement 8 against one side of the implement passage in housing 10 (FIG. 3). The bowed portion of spring 25 slidably engages the opposite side of the implement passage in housing 10. To slide scraper blade 15 out of housing 10, the user pushes inward on grip 16 which compresses spring 25. When grip 16 is pushed in sufficiently far, member 18 disengages from notch 20 (FIG. 5). The user then pushes on grip 16 to slide scraper blade 15 out of the housing. When blade 15 is in the extended position, member 18 locks into notch 21 in housing 10. Blade 15 is now ready for use. Similarly, the user slides tamper 17 out the opposite end of housing 10 until member 18 latches in notch 19. Tamper 17 is now ready for use.

Figure 8:
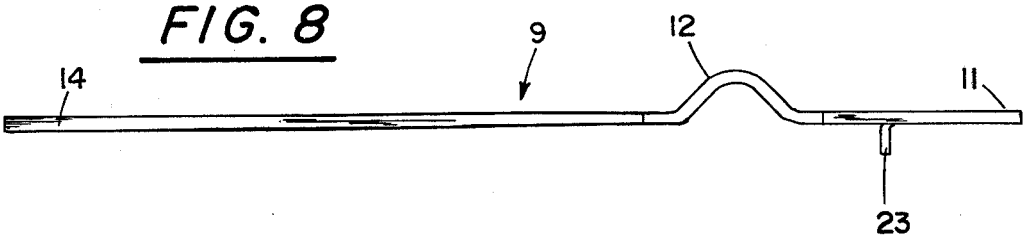
FIG. 8 is a side view of the cigarette holder and pipe pick.

FIGS. 7 and 8 show a second implement 9 including a pipe pick 14 on one end and a cigarette clip 11 on the opposite end. Intermediate pipe pick 14 and cigarette clip 11 is a curved thumb grip 12 for slidable displacement of pick 14 from an implement passage in housing 10. Thumb grip 12 is similar to thumb grip 16 and functions in a similar manner. A protruding member 23 provides means for engagement of spring **25*a* with implement 9. Spring 25*a* is mounted in the implement passage and is substantially identical to spring 25. However, instead of having notch 26 as shown in FIG. 5, spring 25*a* contains a central opening which engages protruding member 23**.

FIG. 6 shows housing 10 with a flat surface 28 that allows the smoker's tool to be set on a table. A clip 30 allows the housing to be fastened to one's pocket. FIG. 6 shows the end of housing 10 containing lip 22 which is adjacent member 11 on implement 9.

Member 11 and lip 22 coact to hold a burning cylindrical object such as a cigarette therebetween. In operation, spring **25*a* resiliently holds member 11 against lip 22 (FIG. 6). For the user to hold a lit object in our smoker's tool, one pushes inward on curved thumb grip 12 thereby separating member 11 from lip 22. The user then inserts the lit article such as a cigarette between lip 22 and member 11. Releasing thumb grip 12 allows the force of spring 25*a* to hold the lit article firmly between member 11 and lip 22. If desired, our smoker'tool can be set on a table to support the burning article over the table surface. Surface 28** provides a stable support while holding the burning article away from the table surface.

The operation and use of pick 14 on implement 9 is similar to use of blade 15 and tamper 17 on implement 8. To use pick 14, one pushes in on thumb grip 12 and slides pick 14 out the end of housing 10. If desired, notches can be provided on implement 9 to lock pick 14 in position.

We claim:

1. A smoker's tool comprising an elongated housing having a surface for supporting the smoker's tool on a table or the like, said elongated housing having a first implement passage therein, a first smoker's implement slidably mounted in said first implement passage, means resiliently holding said first smoker's implement in slidable engagement in said first implement passage; a second implement passage located in said elongated housing, a second smoker's implement slidably mounted in said second implement passage, said second smoker's implement including a member for engaging a cylindrical object, a lip located on said housing, means holding said second smoker's implement within the housing and resiliently biasing said member against said lip, said lip and said member coacting to support a cylindrical object therebetween.

2. The invention of claim 1 wherein said first implement and said second implement are slidable to a work position outside the end of said housing.

3. The invention of claim 2 wherein said first implement has a protrusion thereon for sliding said first implement from said first implement passage.

4. The invention of claim 3 wherein said second implement has a thumb grip thereon.

5. The inventon of claim 4 wherein said housing includes a clip for attachment to a pocket or the like.

6. The invention of claim 5 wherein said first implement includes a tamper on one end and a scraper blade on the opposite end.

7. The invention of claim 6 wherein said second implement includes a pipe pick on one end.

8. The invention of claim 5 wherein said means resiliently holding said first smoker's implement comprises a leaf spring.

9. The invention of claim 8 wherein said housing includes means for locking said first implement in a work position.

* * * * *